US005774765A

United States Patent [19]

Hirota et al.

[11] Patent Number: 5,774,765

[45] Date of Patent: Jun. 30, 1998

[54] CLEANING DEVICE FOR REMOVING RESIDUAL TONER FROM AN IMAGE CARRIER IN AN IMAGE REPRODUCTION APPARATUS

[75] Inventors: Shingo Hirota, Kobe; Naotoshi Kawai, Aichi-ken, both of Japan

[73] Assignee: Minolta Co., Ltd., Osaka, Japan

[21] Appl. No.: 745,338

[22] Filed: Nov. 8, 1996

[30] Foreign Application Priority Data

Nov. 10, 1995 [JP] Japan ..... 7-292470

[51] Int. Cl.[6] ..... G03G 21/00

[52] U.S. Cl. ..... 399/102; 399/350

[58] Field of Search ..... 399/102, 350, 399/351

[56] References Cited

U.S. PATENT DOCUMENTS 5,029,316 7/1991 Koiso ..... 399/102

5,404,216 4/1995 Numagami et al. ..... 399/102

5,455,665 10/1995 Baba et al. ..... 399/358

5,655,178 8/1997 Ishikawa et al. ..... 399/102

*Primary Examiner*—William J. Royer

*Attorney, Agent, or Firm*—McDermott, Will & Emery

[57] ABSTRACT

A cleaning device for removing residual toner on the image bearing member includes a cleaning blade contacting with the surface of the image bearing member and sealing members provided on both end portions of the image bearing member and confronting the cleaning edge of the cleaning blade with a gap. The gap meets the following condition when the average particle diameter per unit volume of the toner used is between 4 μm and 15 μm and the level of condensation is between 5% and 40%, if the width and length of the gap between the cleaning edge and the sealing member are W and L, respectively:

$0<(W/L)<0.4$.

14 Claims, 5 Drawing Sheets

CLEANING DEVICE FOR REMOVING RESIDUAL TONER FROM AN IMAGE CARRIER IN AN IMAGE REPRODUCTION APPARATUS

BACKGROUND OF THE INVENTION

1. Field of the Invention

The present invention relates to a cleaning device, and more particularly, to a cleaning device that is used to remove residual toner on an image bearing member, such as a photosensitive member and dielectric member, in an apparatus that forms images using the electrophotographic method, such as an electrophotographic copy machine, electrophotographic facsimile machine and electrophotographic printer.

2. Description of the Related Arts

As a cleaning device, Japanese Laid-Open Patent Hei 3-291685, for example, discloses a method in which, in addition to a first cleaning blade that is in contact with the photosensitive unit, second and third cleaning blades that are in contact with either end of the photosensitive unit are located such that toner, which escapes the first cleaning blade by moving toward the ends of the image bearing member along the edge of said first blade, is caught using the second and third blades.

Japanese Laid-Open Utility Model Hei 4-3463 discloses a method in which protrusions are placed at either end of the cleaning blade such that the leakage of toner may be prevented by regulating the movement of the toner toward the ends of the image bearing member using these protrusions.

Japanese Laid-Open Patent Hei 6-27861 discloses a method to reduce toner leakage by tilting the ends of the cleaning blade and/or the ends of sealing members placed in contact with these ends of the cleaning blade.

However, in the technologies disclosed by Japanese Laid-Open Patents Hei 3-291685 and Hei 6-27861 described above, while the time that elapses before the escape of toner becomes conspicuous increases somewhat, the escape of toner continues to occur, which leads to a reduction in image quality. In addition, the increase in the number of components as well as in the number of processes due to special processing increases the manufacturing cost as well.

Using the technology disclosed in Japanese Laid-Open Utility Model Hei 4-3463, processing of components is very difficult. Even if said processing is achieved, uniform contact between the cleaning blade and the surface of the image bearing member cannot be obtained. Consequently, distortion of the cleaning blade occurs around the contact portion, and toner escapes through the gap between the cleaning blade and the image bearing member.

SUMMARY OF THE INVENTION

The present invention was developed in consideration of the problems described above. The main object of the present invention is to provide a cleaning device that can prevent toner from escaping.

Another object of the present invention is to provide a cleaning device that can achieve good cleaning results without increasing the number of components or requiring special processing or extra precision in comparison with conventional devices.

Yet another object of the present invention is to provide a cleaning device wherein which toner does not escape through the gaps between the ends of the cleaning blade and the sealing members.

In order to attain the objects described above, the present invention is a cleaning device for removing residual toner on the image bearing member, said cleaning device comprising a cleaning blade contacting with the surface of the image bearing member and sealing members provided on both end portions of the image bearing member and confronting the edge of the cleaning blade with a gap, said gap meeting the following condition when the average particle diameter per unit volume of the toner used is between 4 μm and 15 μm and the level of condensation is between 5% and 40%, if the width and length of the gap between the blade edge and the sealing member are W and L, respectively.

$0<(W/L)<0.4$.

A cleaning device of the present invention comprises a cleaning blade which extends along the axis of the image bearing member and is placed with its edge in contact with the image bearing member and sealing members which are located and pressed against the end areas of the image bearing member at which the blade is not in contact with the image bearing member, each of said sealing members covering the area ranging from the area next to the cleaning blade to the area upstream in the direction of the movement of the image bearing member relative to the blade-contact area, and meeting the following condition when the average particle diameter per unit volume of the toner used is between 4 μm and 15 μm and the level of condensation is between 5% and 40%, if the width and length of the gap between the blade edge and the sealing member are W and L, respectively.

$0<(W/L)<0.4$.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

One embodiment of the image forming apparatus relating to the present invention is explained below with reference to the drawings.

Figure 1:
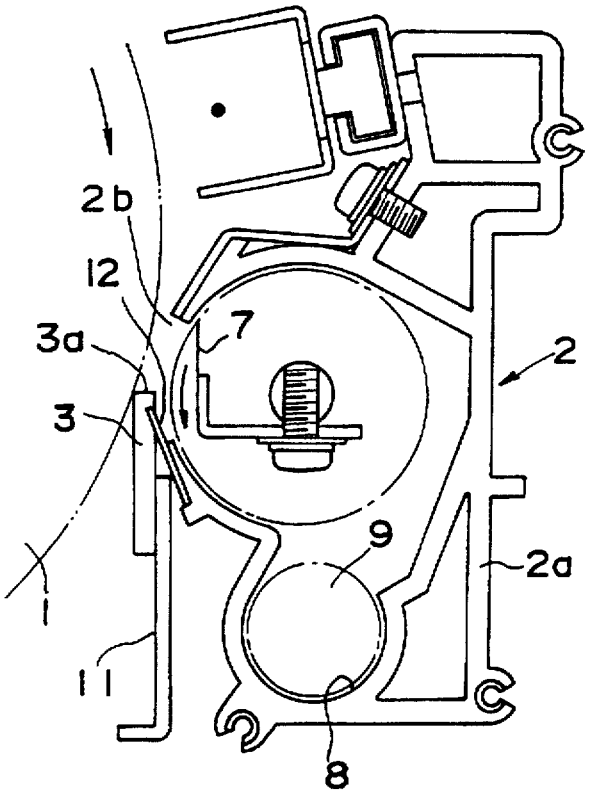
FIG. 1 is a cross-sectional view showing the part containing the cleaning device as one embodiment of the present invention.

FIG. 1 shows a cleaning device in which the present invention is applied. The cleaning device shown in said drawing is generally used in an image forming apparatus using the electrophotographic method. An image bearing member 1 such as a photosensitive member or dielectric member is caused to rotate in the direction indicated by an arrow in the drawing. An electrostatic latent image is formed on this rotating image bearing member 1 via the electrophotographic method, and the latent image is developed into a toner image using toner and then electrostatically transferred onto recording paper to form an image. The recording paper undergoes a fixing process after the transfer. Residual toner exists on the surface of image bearing member 1 after the transfer, and this residual toner is removed by cleaning device 2 in preparation for the formation of the next image.

In cleaning device 2 of this embodiment shown in FIG. 1, cleaning blade 3 is placed essentially vertically with blade edge 3*a* facing up such that it comes into contact with image bearing member 1 from the opposite direction of the direction of rotation of image bearing member 1. The arrangement of cleaning blade 3 is determined based on the locations of other devices such as the developer unit, transfer unit, charger and exposure unit. Therefore, said arrangement of cleaning blade 3 varies depending on how these devices are located. Cleaning blade 3 is fixed at its bottom part on frame 11 which is rotatably supported near cleaning device main unit 2*a*. Spring plate 12 that extends diagonally upward toward image bearing member 1 is fixed to the bottom edge of waste toner inlet 2*b* of cleaning device main unit 2*a*. Blade edge 3a is pressed against image bearing member 1 by the tip of this spring plate 12 and comes into contact with the surface of image bearing member 1 that rotates in the direction indicated by the arrow, scraping off residual toner. Residual toner that is scraped off is received into cleaning device main unit 2*a* via waste toner inlet 2*b*. Waste toner thus received falls into waste toner receiver 8 at the bottom of cleaning device main unit 2*a*, partly due to the rotation of paddle 7. It is then sent and collected into a prescribed waste toner container by conveyer member 9.

Figure 2:
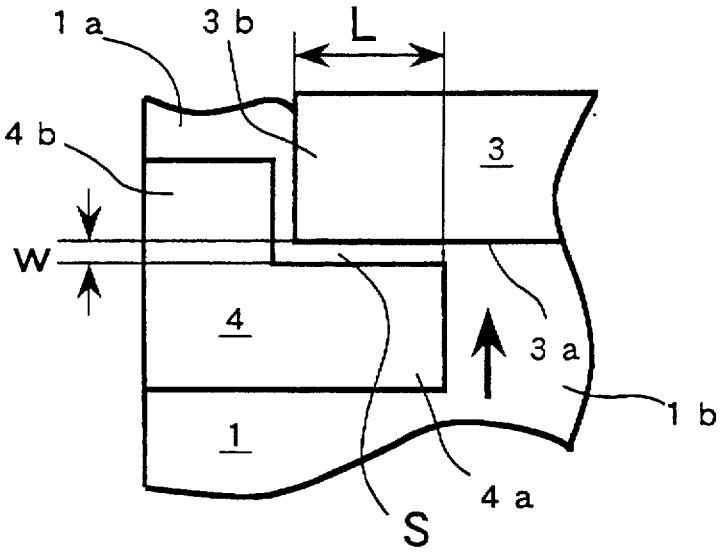
FIG. 2 is a front elevational view showing the relationships among the cleaning blade, the sealing member to prevent toner from escaping and the image bearing member of the cleaning device shown in FIG. 1.
Figure 3:
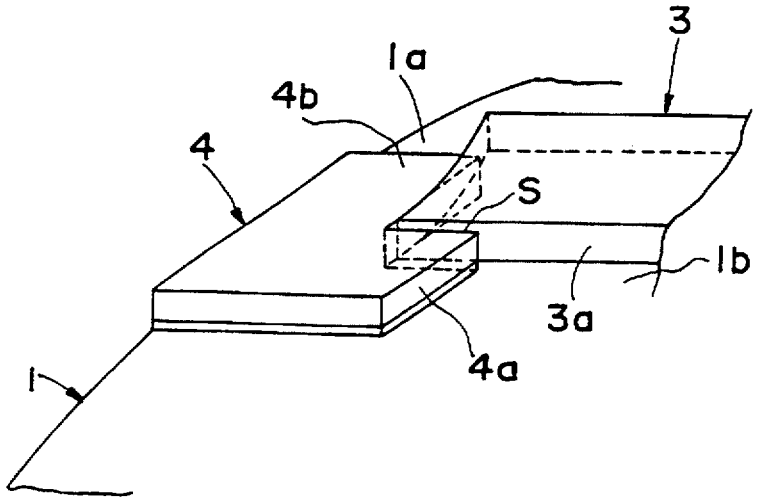
FIG. 3 is a perspective view showing the relationships of the three members shown in FIG. 2.
Figure 4:
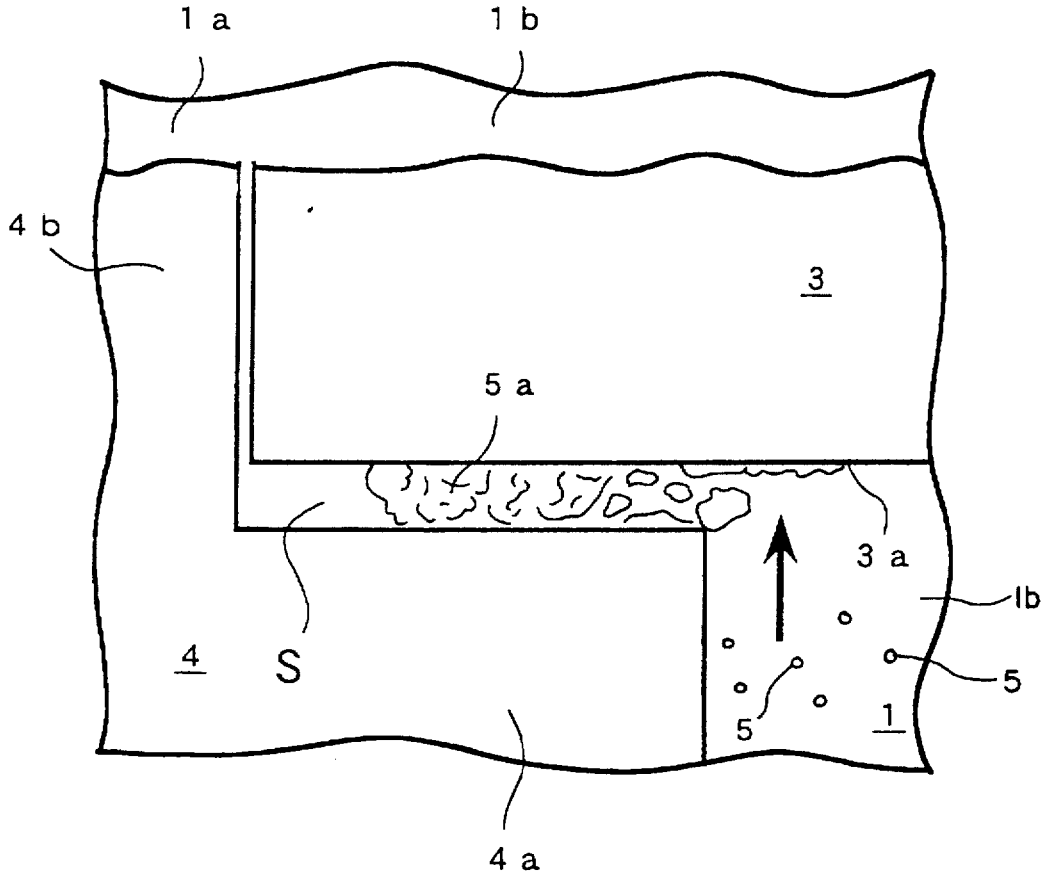
FIG. 4 is a front elevational view showing how the three members shown in FIG. 2 prevent toner from escaping.

The length of cleaning blade 3 is shorter than the length of image bearing member 1 along its axis, as shown in FIGS. 2 and 3. Essentially, it is acceptable so long as the length of blade edge 3*a* of cleaning blade 3 is shorter than image bearing member 1. Sealing members 4 that receive toner 5 that is scraped off by blade edge 3*a* and moves toward the ends of image bearing member 1 along blade edge 3*a* as shown in FIG. 4 are placed on the surface of the areas of image bearing member 1 next to the sides of cleaning blade 3, or in other words, on the surface of image bearing member 1 with which blade edge 3*a* of cleaning blade 3 is not in contact. Specifically, sealing members,4 are attached to frame 11 that holds cleaning blade 3, and are held such that they come into contact with the surface of image bearing member 1 as cleaning blade 3 is pressed by spring plate 12. Each sealing member 4 has extension 4*a* that extends from non-blade contact area la toward blade contact area lb of image bearing member 1 and faces blade edge 3*a* at close range from the 'upstream' side of image bearing member 1 in terms of the direction of movement of image bearing member 1 indicated by an arrow in FIG. 2. Gap S is formed between extension 4*a* and blade edge 3*a*. Specifically, extension 4*a* are located parallel to blade edge 3*a* such that their distance from said blade edge stays constant. Each of sealing members 4 meets the following condition when the average particle diameter per unit volume of toner used is between 4 μm and 15 μm and the level of condensation is between 5% and 40%, if the width and length of gap S between blade edge 3*a* and extension 4*a* of sealing members 4 are W and L, respectively.

$0<(W/L)<0.4$

In this embodiment, each sealing member 4 also has extension 4*b* that extends toward the base of cleaning blade 3 along the side of cleaning blade end 3*a*. However, since the escape of toner 5 is prevented using gap S described above, extension 4*b* is not essential. It is acceptable if there is a gap between blade end 3*b* of cleaning blade 3 and extension 4*b* as shown in FIG. 4, or if extension 4*b* is omitted altogether.

Using this embodiment, when W was lmm and L was 6 mm, no escape of toner 5 occurred. For sealing members 4, moquette made of Teflon fibers was used together with polyurethane foam. However, sealing members 4 are not limited to these materials: elastic synthetic resins, various types of fibers and combinations thereof which easily fit the curved surface of image bearing member 1 and prevent toner 5 from escaping and which create minimal friction and have high durability are most appropriate.

For image bearing member 1, organic materials, inorganic materials or a combination of organic and inorganic materials may be used. For cleaning blade 3, polyurethane rubber, fluoro rubber or Teflon elastic materials may be used. The image bearing member 1 need not be limited to a drum-type apparatus. The present invention may be applied in the same manner where image bearing member 1 has other configurations, such as a belt-type configuration.

The movement of toner 5, and the process of preventing toner escape through gap S in which the occurrence of toner escape is prevented, are explained in more detail with reference to FIG. 4.

Toner 5 is scraped off from image bearing member 1 by blade edge 3*a* and moves while spreading out along blade edge 3*a*. When toner 5 moves, it becomes stagnant during movement due to the friction between it and blade edge 3*a* and a small pile of toner 5 starts to be formed on blade edge 3*a*. Where the level of condensation of toner 5 is low, the pile of toner 5 crumbles without becoming sufficiently large, and toner 5 continues to move toward blade end 3*b*. However, where the level of condensation of toner 5 is at or above a certain level, toner 5 that moves in gap S toward blade end 3*b* along blade edge 3*a* forms a pile that gradually becomes large, and eventually the tip of the pile comes into contact with sealing member 4 in gap S. Then, because the gap between the tip of the pile and sealing member 4 no longer exists, the toner 5 becomes more compact by being pushed by still more toner 5 entering the gap, becoming toner mass 5*a* which blocks gap S and becomes immobile. Toner 5 that attempts to come through gap S then is blocked by this condensed immobile toner mass 5*a*, such that the escape of toner 5 through gap S between blade edge 3*a* of cleaning blade 3 and extension 4*a* of sealing member 4 is prevented.

The pile of toner 5 described above is formed more easily as the level of condensation of toner 5 increases. However, if the level of condensation becomes too high, it is disadvantageous because the agitating and movement of toner inside the developer unit becomes difficult. Therefore, where the toner particle diameter per unit volume is between 4 μm and 15 μm, it is preferred that the level of condensation be set at 5% or more, such that a pile of toner 5 may be formed on blade edge 3*a*, and 40% or less, such that the agitating and conveying inside the developer unit is possible.

Because sealing member 4 does not come into contact with cleaning blade 3 on account of gap S, it does not cause warping of cleaning blade 3. Because toner mass 5*a* described above is appropriately soft, it does not exert excessive pressure against cleaning blade 3, such that a good cleaning condition may be maintained. No adverse effects such as the curling up of cleaning blade 3 or scarring of image bearing member 1 take place.

Therefore, blade edge 3*a* can contact the surface of image bearing member 1 uniformly without influence from other members such as a sealing member over a long period of time, escape of toner does not occur, and a good cleaning capability can be maintained.

Moreover, because the number of components does not increase, and special processing and extra precision are not required, the manufacturing cost does not increase.

Figure 5:
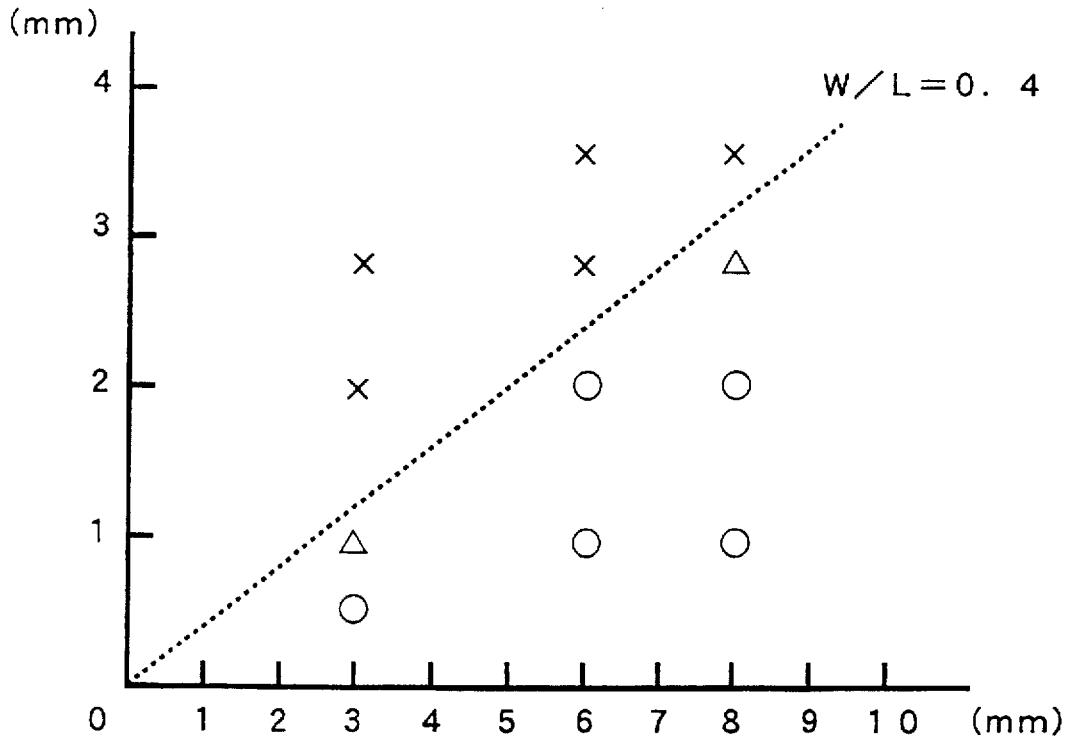
FIG. 5 is a graph showing the results of various toner escape durability tests of the cleaning blade and the sealing member.

FIG. 5 shows the results of durability testing using 15,000 sheets of paper while changing length L and width W of gap S between blade edge 3*a* of cleaning blade 3 and sealing member 4. In FIG. 5, a circle indicates that no escape of toner occurred, a cross indicates that escape of toner occurred for every sheet of paper, and a triangle indicates that escape of toner occurred for some of the sheets of paper.

The toner used in this test was polyethylene toner. Its average particle diameter per unit volume was between 4 μm and 15 μm and the level of condensation was between 5% and 40%, like the toner shown in the embodiment described above. Toner particles with a diameter smaller than 4 μm could not be caught using cleaning blade 3, and toner particles with a diameter larger than 15 μm would not be practical because they produce very poor images. The toner material is not limited to that described above: styrene, acrylic, magnetic or non-magnetic materials may be used as well.

According to FIG. 5, when width W is 0, escape of toner occurs and the probability of toner escape is high when the ratio between width W and length L is 0.4 or higher. Therefore, in this case, when condition $0<(W/L)<0.4$ is met, the minimum acceptable sealing effect can be achieved.

This condition can be easily met by having the value of length L be sufficiently large, which allows for the value of width W to be within a certain range. For example, if length L is set to be at least 5 mm, the sealing effect described above can be achieved so long as width W is within the range of 0 mm to 2 mm.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cleaning device for removing residual toner on an image bearing member having a surface, said cleaning device comprising:

a cleaning blade having a cleaning edge contacting the surface of the image bearing member; and sealing members provided on two end portions of the image bearing member, each forming a gap between itself and the cleaning edge of the cleaning blade, said gap meeting a condition whereby $0<(W/L)<0.4$, wherein W is the width of the gap and L is the length of the gap, when an average particle diameter per unit volume of toner used is between 4 μm and 15 μm and a level of condensation is between 5% and 40%.

2. A cleaning device as claimed in claim 1, wherein the cleaning edge of said cleaning blade contacts the image bearing member from a direction opposite to a direction of rotation of the image bearing member.

3. A cleaning device as claimed in claim 1, wherein said sealing members are located parallel to the cleaning edge of the cleaning blade such that a distance from said cleaning edge stays constant.

4. A cleaning device as claimed in claim 1, wherein each of said sealing members includes a portion which extends along a side of the cleaning blade forming a second gap.

5. A cleaning device as claimed in claim 1, wherein L is at least 5 mm.

6. A cleaning device as claimed in claim 5, wherein W is within a range of approximately 0 mm to 2 mm.

7. A cleaning device as claimed in claim 1, wherein W is within a range of approximately 0 mm to 2 mm.

8. A cleaning device as claimed in claim 1, wherein the removed residual toner concentrates at the gaps between the sealing members and the cleaning edge of the cleaning blade and forms immobile toner masses that block said gaps.

9. A cleaning device for removing residual toner on an image bearing member, said cleaning device comprising:

a cleaning blade which extends along an axis of the image bearing member, said cleaning blade having a cleaning edge contacting the image bearing member; and sealing members located and pressed against end areas of the image bearing member at which the cleaning edge of the cleaning blade is not in contact with the image bearing member, each of said sealing members covering an area extending from an area next to the cleaning blade to an area upstream in a direction of movement of the image bearing member relative to an area where the cleaning edge of the cleaning blade contacts the image bearing member, forming a gap between the sealing member and the cleaning edge of the cleaning blade, and meeting a condition whereby $0<(W/L)<0.4$, wherein W is the width of the gaps and L is the length of the gaps, when an average particle diameter per unit volume of toner used is between 4 μm and 15 μm and a level of condensation is between 5% and 40%.

10. A cleaning device as claimed in claim 9, wherein said sealing members are located parallel to the cleaning edge of the cleaning blade such that a distance from said cleaning edge stays constant.

11. A cleaning device as claimed claim 9, wherein L is at least 5 mm.

12. A cleaning device as claimed in claim 11, wherein W is within a range of approximately 0 mm to 2 mm.

13. A cleaning device as claimed in claim 9, wherein W is within a range of approximately 0 mm to 2 mm.

14. A cleaning device as claimed in claim 9, wherein the removed residual toner concentrates at the gaps between the sealing members and the cleaning edge of the cleaning blade and forms immobile toner masses that block said gaps.

* * * * *